US005823814A

United States Patent [19]

Alwine

[11] Patent Number: 5,823,814

[45] Date of Patent: Oct. 20, 1998

[54] CONNECTOR MODULE HAVING CONNECTOR POSITIVE ASSURANCE MEMBER AND INTERNALLY LATCHING CONNECTOR HOUSINGS

[75] Inventor: K. Troy Alwine, Warren, Pa.

[73] Assignee: Osram Sylvania Inc., Danvers, Mass.

[21] Appl. No.: 652,080

[22] Filed: May 23, 1996

[51] Int. Cl.[6] ..... H01R 13/627

[52] U.S. Cl. ..... 439/352; 439/353

[58] Field of Search ..... 439/345, 350, 439/347, 352, 353, 357, 488, 489

[56] References Cited

U.S. PATENT DOCUMENTS 5,236,373 8/1993 Kennedy ..... 439/347
5,370,550 12/1994 Alwine et al. ..... 439/352
5,425,653 6/1995 Koiso ..... 439/489 X
5,637,009 6/1997 Tsuji et al. ..... 439/489 X

*Primary Examiner*—Khiem Nguyen
*Attorney, Agent, or Firm*—William H. McNeill

[57] ABSTRACT

A connector module and a connector module kit which includes the components of the connector module, is provided. The connector module includes a first housing, a second housing and a connector positive assurance member. Insertion of the second housing into the first housing will cause a latching mechanism located within the assembled first and second housings to latch the housings together so that they can not be readily disengaged. When the first and second housings and contacts therein are fully engaged in this manner, the connector positive assurance member may be moved from a first position to a second position to assure complete engagement has been effected. If the first and second housings and contacts therein are not fully engaged, the connector positive assurance member can not be moved from such first position to such second position.

20 Claims, 2 Drawing Sheets

CONNECTOR MODULE HAVING CONNECTOR POSITIVE ASSURANCE MEMBER AND INTERNALLY LATCHING CONNECTOR HOUSINGS

TECHNICAL FIELD

The present invention relates to a connector module which includes internal latch engagement members and comprises a first housing which mates with a second housing, and a connector positive assurance member which assures that the housings are fully mated and contacts therein are fully engaged.

BACKGROUND ART

It is occasionally desirable to provide electrical connectors which may be mechanically and electrically connected together but not readily disconnected. For example, the ability to easily disconnect an electrical connector creates a potential safety hazard in high voltage applications. Such a concern exists in some electrical connections located under the hood of a motor vehicle. One known device to deter separation of electrical connectors involves the use of mating connector housings which are snap fit together, a lock disabler being provided to prevent unsnapping thereof. U.S. Pat. No. 5,370,550 is an example of such a device. However, a device of this type may be disconnected, if desired. Other known devices rely upon the use of connector position assurance (CPA) members such as described in U.S. Pat. No. 5,236,373. In structures of this type the CPA engages mating connector housings exterior thereof to lock such housings together. Such a CPA is not designed for use with connectors having internal latches which are not exposed to the outside of the connector. However, when internal latches are provided, use of a CPA would be desirable to assure that the connector housings and contacts therein are mated, since there typically is no visual indication of such mating.

DISCLOSURE OF THE INVENTION

It is, therefore, an object of the present invention to provide a connector module which obviates the disadvantages of the prior art.

It is yet another object of the present invention to provide a connector module having a connector positive assurance member which can only be actuated when the connector module is fully engaged.

It is another object of the present invention to provide such a connector module having a connector positive assurance member which is preinstalled to one of the connector housings of the connector module.

A further object of the present invention is to provide such a connector module having a connector positive assurance member and including latch engagement members which are hidden from view when in a mated state.

Another object of the present invention is to provide such a connector module which is particularly useful in high voltage applications.

This invention achieves these and other objects by providing a connector module. The connector module comprises a first housing, a second housing and a connector positive assurance member. The first housing extends in the direction of a first longitudinal axis and comprises at least one first latch engagement member and a channel. The channel comprises a first side and a spaced second side which extend between a channel base and a wall of the first housing, the channel extending in the direction of, and protruding away from, the longitudinal axis. The first side comprises a first opening.

The second housing extends in the direction of a second longitudinal axis and comprises at least one second latch engagement member, and a tab protruding from an outer surface of the second housing away from the second longitudinal axis. The first housing and the second housing are slidably engaging such that the second housing is extendable into the first housing, the first latch engagement member is latchable to the second latch engagement member at a position inside the first housing, and the tab is extendable into the channel. The tab is slidable along the channel to a position adjacent the first opening when the connector module is in a closed mode.

The connector positive assurance member is movably attached to the first housing and comprises a locking segment. The locking segment is moveable, when the connector module is in the closed mode and the tab is adjacent the first opening, from a first position which is adjacent the first opening and outside of the channel to a second position which is between the tab and the first wall and inside of the channel.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
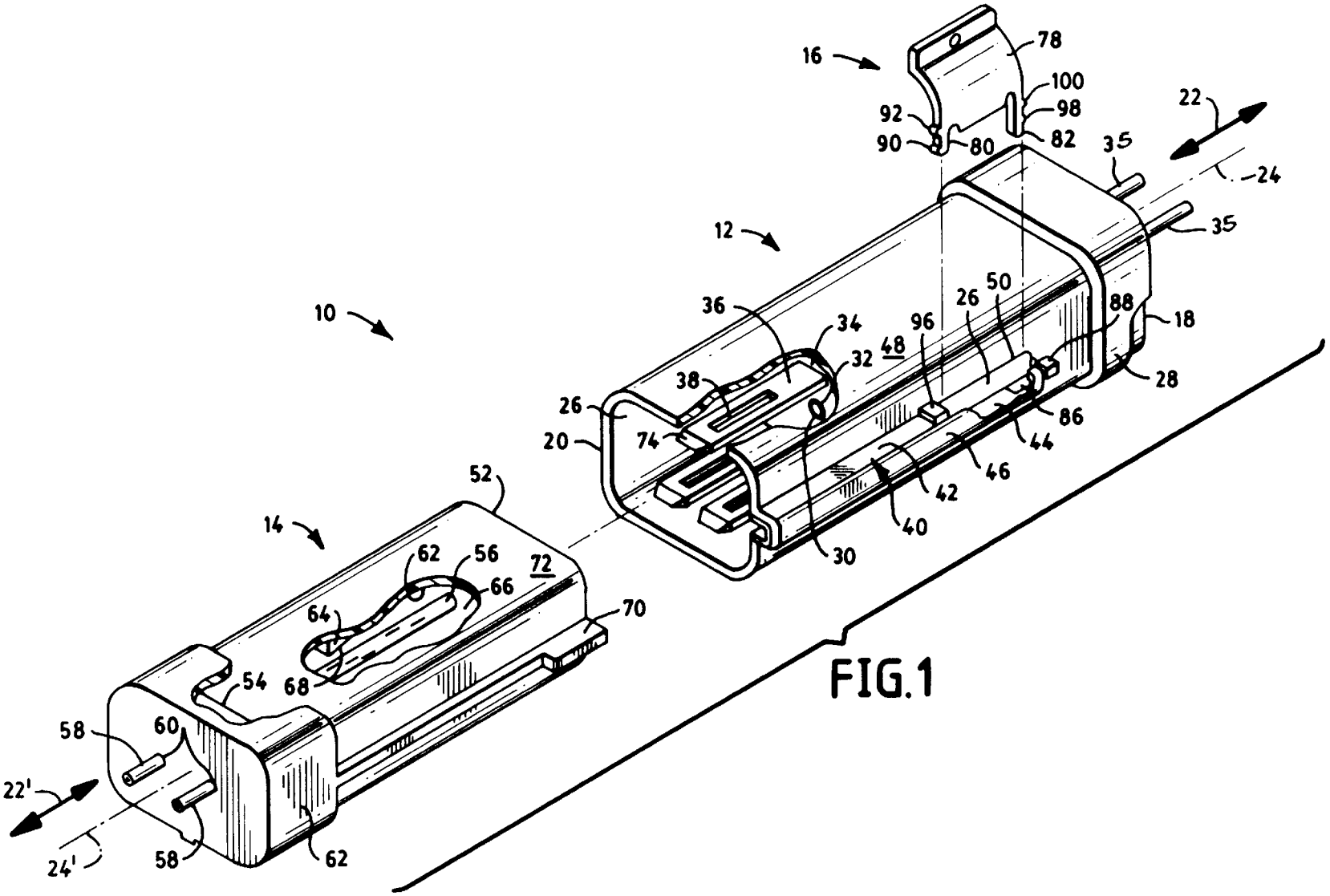
FIG. 1 is an exploded perspective view of the connector module of the present invention.

Referring now to the drawings with greater particularity, FIG. 1 depicts a connector module 10 which comprises a non-conductive first housing 12, a mating non-conductive second housing 14, and a connector positive assurance member 16.

In the embodiment of FIG. 1, the housing 12 extends from an end 18 to an opposite end 20 in a direction 22 of a longitudinal axis 24. Housing 12 comprises a cavity 26 therein and a cover 28 which encloses the end 18. Each of the non-conductive housings of the present invention contain at least one contact therein. In the embodiment of FIG. 1 two contacts 30 (only one is visible in FIG. 1) are positioned in the cavity 26. Contacts 30 are each press fit into a respective bore 32 of a portion 34 of the housing 12 which extends into cavity 26. Each contact 30 comprises a female contact fabricated from a conventional ferrule which extends into a respective bore 32 of portion 34, each ferrule extending towards end 20. Conductors 35 extend through respective bores (not shown) in cover 28 for conventional electrical and mechanical attachment to a respective contact 30. For example, each conductor 35 may be soldered to a respective contact 30 in the usual manner.

Housing 12 also comprise at least one first latch engagement member. In the embodiment of FIG. 1, there are three first latch engagement members 36 each of which is in the form of a resilient metal prong having an aperture 38 therethrough. Latch engagement members 36 extend from portion 34 towards end 20.

Housing 12 also comprises a channel 40 formed by a first side 42 and a second side 44 spaced therefrom, sides 42 and 44 extending between a channel base 46 and a wall 48 of the housing 12. The channel 40 extends in the direction 22 of, and protrudes away from, longitudinal axis 24. The first side 42 of the channel 40 comprises a first opening 50.

In the embodiment of FIG. 1, the housing 14 extends from an end 52 to an opposite end 54 in the direction 22' of longitudinal axis 24'. Housing 14 comprises a portion (not shown) similar to portion 34 having two bores (not shown) similar to bores 32, a respective contact 56 (only one is visible in FIG. 1) being press fit into a respective bore. Each contact 56 is in the form of a male contact fabricated from a conventional male prong which extends towards end 52 of housing 14 for electrical and mechanical engagement with contact 30. Conductors 58 extend into housing 14 through respective bores 60 in a cover 62, which encloses end 54, in the same manner in which conductors 35 extend through respective bores of cover 28 and into housing 12 for attachment to contacts 30 as described above. Conductors 58 extend into housing 14 for conventional electrical and mechanical attachment to a respective contact 56. For example, each conductor 58 may be soldered to a respective contact 56 in the usual manner.

An inner surface 62 of housing 14 comprises at least one latch engagement member. In the embodiment of FIG. 1, three latch engagement members 64 are provided in the form of protuberances (only one is visible in FIG. 1) each of which extends into the cavity 66 of housing 14 towards axis 24' from surface 62. In the preferred embodiment, each latch engagement member 64 will be in alignment with a respective latch engagement member 36 when housings 12 and 14 are assembled together as described herein. In the preferred embodiment, each protuberance 64 comprises a cam surface such as cam surface 68.

The housing 14 comprises a tab 70 which protrudes from an outer surface 72 of the housing 14 and extends away from the longitudinal axis 24'.

Housings 12 and 14 are slidably engaging to the extent that the housing 14 is slidable into housing 12, each latch engagement member 36 is latchable to a respective latch engagement member 64 at a position inside cavity 26 of housing 12, and tab 70 is slidable into channel 40. Tab 40 will be adjacent opening 50 when the connector module 10 is in a closed mode. The connector module 10 will be in such closed mode when each contact 30 is fully electrically and mechanically connected to a respective contact 56. To facilitate mating housings 12 and 14 in this manner, in the preferred embodiment the latch engagement members 36 comprise cam surfaces 74. As the housings 12 and 14 are mated by inserting end 52 of housing 14 into cavity 26 of housing 12, and inserting tab 70 into channel 40, each cam surface 74 will engage a respective cam surface 68 which will cause each latch engagement member 36 to be deflected towards axis 24. The latch engagement members 36 will return to their normal position as the protuberances 64 snap into respective openings 38 to lock the housings 12 and 14 together.

Although three latch engagement members 36 and three mating protuberances 64, are provided, more or less of such latch engagement members and mating protuberances may be provided. In addition, it will be apparent to those having ordinary skill in the art that the protuberances 64 and openings 38 may be reversed such that the openings in the latch engagement member 36 will be replaced with protuberances and the protuberances extending from the inner surface 62 will be replaced with openings which mate with such protuberances. Regardless of the number of protuberances and mating openings, when the housings 12 and 14 are properly mated together in the closed mode, the contacts 30 and 56 will be properly electrically and mechanically connected and the latching mechanism provided by such protuberances and mating openings will be positioned within the connector module 10 so that the latching mechanism may not be readily disengaged and is hidden from view.

In order to assure that the contacts 30 and 56 are fully engaged, the connector positive assurance member 16 is provided. Connector positive assurance member 16 is movably attached to housing 12 and comprises a locking segment which is movable, when the connector module 10 is in a closed mode and the tab 70 is adjacent opening 50, from (a) a first position which is adjacent opening 50 and outside of the channel 40 to (b) a second position which is between the tab 70 and the wall 42 and inside the channel 40. In the embodiment of FIG. 1, connector positive assurance member 16 comprises a body 78, a first leg 80 and a second leg 82 spaced from such first leg. Legs 80 and 82 extend from the body 78, and the locking segment of connector positive assurance member 16 comprises leg 80.

Figure 2:
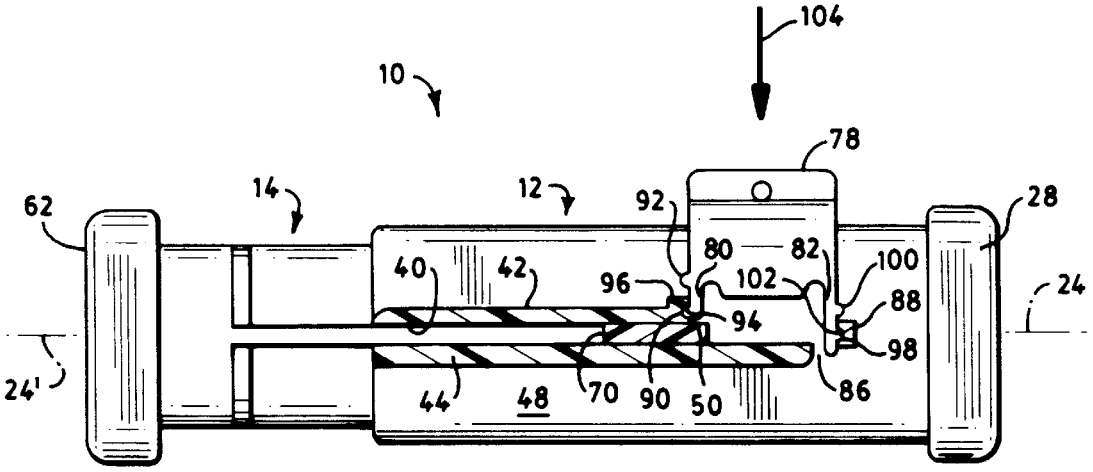
FIG. 2 is a diagrammatic view, partially in section, of the connector module of FIG. 1 in an open mode.
Figure 3:
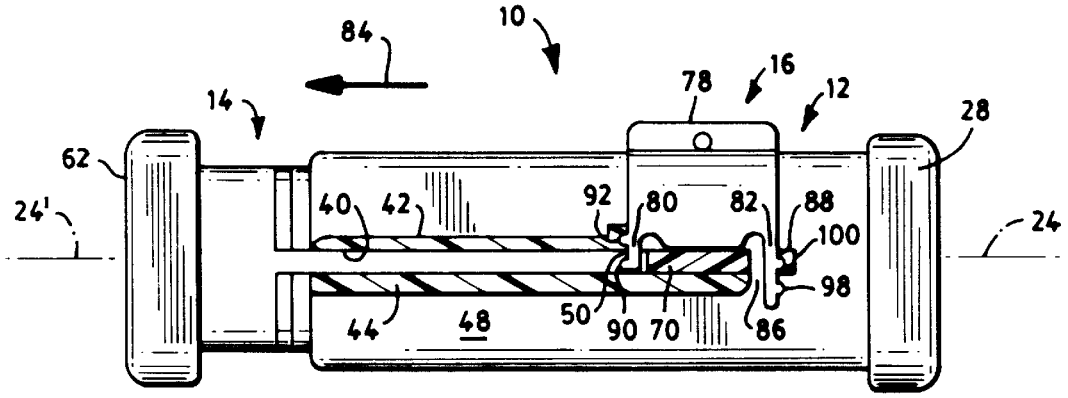
FIG. 3 is a diagrammatic view, partially in section, of the connector module of FIG. 1 in a closed mode.

FIG. 2 depicts the connector module 10 of FIG. 1 in an open mode wherein the contacts 30 and 56 (not shown) are not fully engaged. When in such open mode, the locking segment comprising leg 80 is in a first position wherein leg 80 is adjacent opening 50 and outside of the channel 40. FIG. 3 depicts the connector module 10 of FIG. 1 in a closed mode wherein the contacts 30 and 56 (not shown) are fully engaged. When in such closed mode, the locking segment comprising leg 80 is in a second position wherein leg 80 is positioned between tab 70 and the wall 42 of channel 40, and inside of channel 40. When in the open mode wherein the contacts are not fully engaged, the connector positive assurance member 16 can not be moved to the second position depicted in FIG. 3 since movement of leg 80 into channel 40 will be prevented by tab 70 as depicted in FIG. 2. When in the closed mode, wherein the contacts are fully engaged, the connector positive assurance member can be moved to the second position as depicted in FIG. 3, and disengagement of contacts 30 and 56 will be prevented by the presence of arm 80 between wall 42 of housing 12 and tab 70 of housing 14 which will prevent movement of the housing 14, relative to housing 12, in the direction 84.

In the embodiment of FIGS. 1 to 3, the side 44 of the channel 40 comprises an opening 86 which is positioned opposite opening 50 of side 42. In such embodiment, the leg 82 is extendible through opening 86 when the connector module 10 is in the closed mode depicted in FIG. 3.

In the embodiment of FIGS. 1 to 3, the connector positive assurance member 16 is movably attached to the housing 12 in such a manner that housing 12 holds the connector positive assurance member in place in the first position depicted in FIG. 2 when the connector module 10 is in an open mode and in the second position depicted in FIG. 3 when the connector module 10 is in a closed mode. To this end, a detent 88 is provided which extends away from wall 48 of housing 12 and away from the longitudinal axis 24. Detent 88 is adjacent opening 50. In the embodiment of FIGS. 1 to 3, the connector positive assurance member 16 is movably held in place by the engagement of leg 80 with wall 42 and the engagement of leg 82 with the detent 88. Such mounting of the connector positive assurance member 16 upon housing 12 may be facilitated by fabricating the connector positive assurance member from a plastic material such that at least one of the legs 80, 82 is flexible and resilient and, in combination with wall 42 or detent 88, respectively, comprises a slidably engaging lock. In the embodiment of FIGS. 1 to 3, legs 80 and 82 are each flexible and resilient and in combination with wall 42 and detent 88, respectively, form a respective first and a second slidably engaging lock. By way of example, the slidably engaging lock formed by leg 80 and wall 42 comprises protuberances 90 and 92 of leg 80 and a mating recess 94 provided in an end segment 96 of wall 42. Similarly, the slidably engaging lock formed by leg 82 and detent 88 comprises protuberances 98 and 100 of leg 82 and a mating recess 102 provided in detent 88. In such embodiment, in the open mode depicted in FIG. 2 the connector positive assurance member 16 is movably held in place relative to housing 12 by the engagement of protuberances 90 and 98 with respective recesses 94 and 102, the connector positive assurance member being dimensioned such that the resilience of legs 80 and 82 urges protuberance 90 and 98 into respective recesses 94 and 102. When the contacts 30 and 56 are fully engaged as described herein, the operator may move the connector positive assurance member 16 from the position depicted in FIG. 2 to the position depicted in FIG. 3 by urging the body 78 of the connector positive assurance member 16 in the direction of arrow 104 to such an extent that the resilient engagement between protuberances 90 and 98 and respective recesses 94 and 102 is overcome and the connector positive assurance member is moved to the position depicted in FIG. 3. In the closed mode of FIG. 3, the connector positive assurance member 16 is movably held in place relative to housing 12 by the engagement of protuberances 92 and 100 with respective recesses 94 and 102, the connector positive assurance member being dimensioned such that the resilience of legs 80 and 82 urges protuberances 92 and 100 into respective recesses 94 and 102.

Fabrication of the various components described herein may be accomplished using conventional procedures. For example, the housings, housing covers and connector positive assurance member may be molded from a plastic material. The conductive male and female contacts may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A connector module comprising:

a first housing extending in the direction of a first longitudinal axis and comprising at least one first latch engagement member and a channel, said channel comprising a first side and a spaced second side which extend between a channel base and a first wall of said first housing, said channel extending in the direction of, and protruding away from, said longitudinal axis, said first side comprising a first opening;

a second housing extending in the direction of a second longitudinal axis and comprising at least one second latch engagement member, and a tab protruding from an outer surface of said second housing away from said second longitudinal axis, said first housing and said second housing being slidably engaging such that said second housing is extendable into said first housing, said at least one first latch engagement member is latchable to said at least one second latch engagement member at a position inside said first housing, and said tab is extendable into said channel, said tab being slidable along said channel to a position adjacent said first opening when said connector module is in a closed mode; and a connector positive assurance member movably attached to said first housing and comprising a locking segment, said locking segment being moveable, when said connector module is in said closed mode and said tab is adjacent said first opening, from a first position which is adjacent said first opening and outside of said channel to a second position which is between said tab and said first wall and inside of said channel.

2. The connector module of claim 1 wherein said connector positive assurance member comprises a body, and a first leg and a spaced second leg each extending from said body, said locking segment comprising said first leg.

3. The connector module of claim 1 wherein said connector positive assurance member comprises a body, and a first leg and a spaced second leg each extending from said body, said locking segment comprising said first leg, and further wherein said second side comprises a second opening positioned opposite said first opening, said second leg being extendable through said second opening when said connector module is in said closed mode.

4. The connector module of claim 1 wherein said first housing further includes a detent extending from said wall and away from said first longitudinal axis, said first opening being located adjacent said detent.

5. The connector module of claim 4 wherein said connector positive assurance member comprises a body, and a first leg and a spaced second leg, each extending from said body, said locking segment comprising said first leg, and said connector positive assurance member being movably attached to said first housing by engagement of said first leg with said wall and engagement of said second leg with said detent.

6. The connector module of claim 5 wherein said second side comprises a second opening positioned opposite said first opening, said second leg being extendable through said second opening when said connector module is in said closed mode.

7. The connector module of claim 5 wherein said wall and said first leg comprise at least one slidably engaging lock.

8. The connector module of claim 5 wherein said detent and said second leg comprise at least one slidably engaging lock.

9. The connector module of claim 7 wherein said detent and said second leg comprises at least one other slidably engaging lock.

10. The connector module of claim 7 wherein said second side comprises a second opening positioned opposite said first opening, said second leg being extendable through said second opening when said connector module is in said closed mode.

11. The connector module of claim 8 wherein said second side comprises a second opening positioned opposite said first opening, said second leg being extendable through said second opening when said connector module is in said closed mode.

12. The connector module of claim 9 wherein said second side comprises a second opening positioned opposite said first opening, said second leg being extendable through said second opening when said connector module is in said closed mode.

13. A connector module comprising:

a first housing extending in the direction of a first longitudinal axis and comprising at least one first latch engagement member and a channel, said channel comprising a wall, said channel extending in the direction of, and protruding away from, said longitudinal axis, said wall comprising a first opening;

a second housing extending in the direction of a second longitudinal axis and comprising at least one second latch engagement member, and a tab protruding from an outer surface of said second housing away from said second longitudinal axis, said first housing and said second housing being slidably engaging such that said second housing is extendable into said first housing, said at least one first latch engagement member is latchable to said at least one second latch engagement member, and said tab is extendable into said channel, said tab being slidable along said channel to a position adjacent said first opening when said connector module is in a closed mode; and a connector positive assurance member movably attached to said first housing and comprising a locking segment, said locking segment being moveable, when said connector module is in said closed mode and said tab is adjacent said first opening, to a position which is between said tab and said wall and inside of said channel.

14. The connector module of claim 13 wherein said connector positive assurance member comprises a body, and a first leg and a spaced second leg each extending from said body, said locking segment comprising said first leg, and further wherein said wall comprises a second opening positioned opposite said first opening, said second leg being extendable through said second opening when said connector module is in said closed mode.

15. The connector module of claim 13 wherein said first housing further includes a detent extending from said wall and away from said first longitudinal axis, said first opening being located adjacent said detent.

16. The connector module of claim 15 wherein said connector positive assurance member comprises a body, and a first leg and a spaced second leg, each extending from said body, said locking segment comprising said first leg, and said connector positive assurance member being movably attached to said first housing by engagement of said first leg with said wall and engagement of said second leg with said detent.

17. The connector module of claim 16 wherein said second side comprises a second opening positioned opposite said first opening, said second leg being extendable through said second opening when said connector module is in said closed mode.

18. A connector module comprising:

a first housing extending in the direction of a first longitudinal axis and comprising at least one first latch engagement member, at least one first contact, and a channel, said channel comprising a wall, said channel extending in the direction of, and protruding away from, said longitudinal axis, said wall comprising a first opening; a second housing extending in the direction of a second longitudinal axis and comprising at least one second latch engagement member, at least one second contact, and a tab protruding from an outer surface of said second housing away from said second longitudinal axis, said first housing and said second housing being slidably engaging such that said second housing is extendable into said first housing, said at least one first latch engagement member is latchable to said at least one second latch engagement member, said at least one first contact is electrically and mechanically connectable to said at least one second contact, and said tab is extendable into said channel, said tab being slidable along said channel to a position adjacent said first opening when said connector module is in a closed mode; and a connector positive assurance member movably attached to said first housing and comprising a locking segment, said locking segment being moveable, when said connector module is in said closed mode and said tab is adjacent said first opening, to a position which is between said tab and said wall and inside of said channel.

19. The connector module of claim 18 wherein said connector positive assurance member comprises a body, and a first leg and a spaced second leg each extending from said body, said locking segment comprising said first leg, and further wherein said wall comprises a second opening positioned opposite said first opening, said second leg being extendable through said second opening when said connector module is in said closed mode.

20. The connector module of claim 19 wherein said first housing further includes a detent extending from said wall and away from said first longitudinal axis, said first opening being located adjacent said detent, and said connector positive assurance member being movably attached to said first housing by engagement of said first leg with said wall and engagement of said second leg with said detent.

* * * * *